US011248299B2

(12) United States Patent
Xue et al.

(10) Patent No.: US 11,248,299 B2
(45) Date of Patent: Feb. 15, 2022

(54) COMBINED TREATMENT METHOD FOR IMPROVING CORROSION RESISTANCE OF METAL COMPONENT IN CHLORINE-CONTAINING SOLUTION

(71) Applicants: Institute of Laser and Optoelectronics Intelligent Manufacturing, Wenzhou University, Zhejiang (CN); JiangSu University, Jiangsu (CN)

(72) Inventors: Yao Xue, Zhejiang (CN); Kaiyu Luo, Jiangsu (CN); Haifei Lu, Jiangsu (CN); Jinzhong Lu, Jiangsu (CN)

(73) Assignees: Institute of Laser and Optoelectronics Intelligent Manufacturing, Wenzhou University, Zhejiang (CN); JiangSu University, Jiangsu (CN)

( * ) Notice: Subject to any disclaimer, the term of this patent is extended or adjusted under 35 U.S.C. 154(b) by 904 days.

(21) Appl. No.: 16/066,305

(22) PCT Filed: Oct. 9, 2017

(86) PCT No.: PCT/CN2017/105316
§ 371 (c)(1),
(2) Date: Jun. 27, 2018

(87) PCT Pub. No.: WO2019/006901
PCT Pub. Date: Jan. 10, 2019

(65) Prior Publication Data

US 2021/0164106 A1 Jun. 3, 2021

(30) Foreign Application Priority Data

Jul. 5, 2017 (CN) ..... 201710541125.9

(51) Int. Cl.
*C23C 22/76* (2006.01)
*C21D 10/00* (2006.01)
(Continued)

(52) U.S. Cl.
CPC ..... *C23C 22/76* (2013.01); *C21D 10/005* (2013.01); *C23C 22/78* (2013.01); *C23C 22/83* (2013.01)

(58) Field of Classification Search
None
See application file for complete search history.

(56) References Cited

U.S. PATENT DOCUMENTS

2004/0224179 A1* 11/2004 Sokol ..... C21D 10/005 428/610
2018/0258509 A1* 9/2018 Lu ..... C21D 10/005

* cited by examiner

*Primary Examiner* — Shamim Ahmed
*Assistant Examiner* — Bradford M Gates
(74) *Attorney, Agent, or Firm* — JCIPRNET

(57) ABSTRACT

Disclosed is a combined treatment method for improving corrosion resistance of metal component in chlorine-containing solution. First, the metal component is placed in the chlorine-containing solution. Large-area overlapping laser shock peening without an absorbing layer is used, when laser pulses are irradiated on the target metal component, the metal matrix surface absorbs the laser energy, vaporizes and expands to form a high-temperature and high-pressure plasma, a chlorine-containing passivation film is formed, to improve the surface corrosion resistance of the metal component. After that, the surface layer of the metal component is subjected to surface polishing, followed by large-area overlapping laser shock peening with an absorbing layer at room temperature, to further improve the corrosion resistance of the metal component. The combined treatment method of the present invention can be applied to improve the corrosion resistance of metal components in highly corrosive chlorine-containing environments of seawater and the like.

6 Claims, 2 Drawing Sheets

(51) Int. Cl.
*C23C 22/78* (2006.01)
*C23C 22/83* (2006.01)

COMBINED TREATMENT METHOD FOR IMPROVING CORROSION RESISTANCE OF METAL COMPONENT IN CHLORINE-CONTAINING SOLUTION

CROSS-REFERENCE TO RELATED APPLICATION

This application is a 371 of international application of PCT application serial no. PCT/CN2017/105316, filed on Oct. 9, 2017, which claims the priority benefit of China application no. 201710541125.9, filed on Jul. 5, 2017. The entirety of each of the above-mentioned patent applications is hereby incorporated by reference herein and made a part of this specification.

BACKGROUND OF THE INVENTION

1. Field of the Invention

The present invention relates to the field of special processing and materials science, and more particularly to improvement of corrosion resistance of a metal component by firstly performing large-area overlapping laser shock peening without an absorbing layer on the metal component using a chlorine-containing solution as constraining layer, polishing the surface, and then treating the surface of the metal component by means of large-area overlapping laser shock peening with an absorbing layer at room temperature.

2. Description of Related Art

Offshore Engineering is very extensive in the content and the scope. In a broad sense, offshore engineering equipment includes ocean fishery equipment, offshore oil and gas development equipment, offshore transportation equipment, offshore tourism equipment, offshore power equipment, and offshore construction equipment. And in the narrow sense, it mainly refers to offshore oil and gas development equipment. The offshore oil and gas production contain 4 stages: Exploration, Development, Production and Decommission. From the initial stage, geophysical exploration, to the final stage of the platform decommission, each stage is related to many offshore engineering equipments. Offshore oil and gas development equipment can be divided into drilling platform, production platform, offshore engineering ship, and so on. With the continuous development of offshore oil and gas resources into the deep sea, the market in offshore engineering equipment is promising.

Seawater is an electrolytic solution where a lot of NaCl solute is present that can react with many substances, and metals are destroyed by physical, chemical, and biological factors in seawater. Corrosion of the metal structures results in thinner materials, reduced strength, and sometimes local perforation or fracture, and even damage to the structures. Alloy steel immersed in seawater may suffer from local corrosion. Chloride ions are readily adsorbed onto a passivation film so that oxygen atoms are removed, and then bind to cations in the passivation film to form soluble chlorides. As a result, small cavities are created by corrosion on exposed matrix metals. These small cavities are called pitting nucleus. These chlorides are readily hydrolyzable, the pH of the solution decreases due to the small cavities, the solution becomes acidic, a part of oxide films are dissolved, causing excessive metal ions, in order to balance electrical neutrality in corrosion cavities, $Cl^-$ ions continuously migrate inward from the outside. The process is constantly repeated, austenitic stainless is continuously etched in an increasing speed, and corrosion develops in the depth direction of holes, until perforations are created. Under the action of both tensile stress and corrosive medium, stress corrosion cracking of steel can occur; under the action of waves or other periodic forces, corrosion fatigue and thus damage of the metal structure can occur, which is a source of structural damage to offshore engineering equipments and has become one of the concerns affecting safe operation of offshore engineering equipments. Therefore, the research for improving corrosion resistance of a metal component in a chlorine-containing solution is of great significance.

Laser shock peening is an effective material surface peening technology. Large-area overlapping laser shock peening without an absorbing layer is performed using a chlorine-containing solution as constraining layer, a chlorine-containing passivation film is induced on the surface of the metal matrix, polishing is performed, and then large-area overlapping laser shock peening with an absorbing layer at room temperature is performed for further peening of the metal component, thereby greatly improving corrosion resistance of the metal component.

SUMMARY OF THE INVENTION

An object of the present invention is to provide a combined treatment method for improving corrosion resistance of a metal component in a chlorine-containing solution, so as to further improve corrosion resistance of the metal component in the chlorine-containing solution.

In order to solve the above technical problem, in the present invention, using a chlorine-containing solution as constraining layer, large-area overlapping laser shock peening without an absorbing layer is performed, chloride ions in the chlorine-containing solution and the surface metals are induced by a laser to form a passivation film, polishing is performed, and then large-area overlapping laser shock peening with an absorbing layer at room temperature is performed, thereby improving corrosion resistance of the metal component in the chlorine-containing solution.

Specific technical solutions are as follows:

A combined treatment method for improving corrosion resistance of a metal component in a chlorine-containing solution, characterized in that, firstly, the metal component is placed in the chlorine-containing solution, wherein the liquid level of the solution is higher than the surface of the component or a shock point by 1-2 mm, and the solution is maintained to circulate; large-area overlapping laser shock peening absorbing layer is used, when laser pulses are irradiated on the target metal component, the metal matrix surface absorbs the laser energy and vaporizes and expands to form a high-temperature and high-pressure plasma, the chlorine-containing solution as constraining layer limits expansion of the plasma, generating a high-pressure shock wave having a strength of up to several to several tens GPa which far exceeds a yield strength of the metal component, so that the surface suffers from severe plastic deformation, the surface grains are refined and even nano-crystallized, a high value residual compressive stress is induced in the shock region, and chloride ions in the chlorine-containing solution and the surface metals are induced by the laser to form a chlorine-containing passivation film, such that the surface corrosion resistance of the metal component is improved; after the large-area overlapping laser shock peening without absorbing layer is conducted, surface polishing is conducted on the surface layer of the metal component; and then, the surface of the metal component is subjected to large-area overlapping laser shock peening with an absorbing layer at the room temperature, such that the corrosion resistance of the metal component is further improved; the method comprising the following steps:

step 1: a sample to be treated is subjected to progressive grinding using a metallographic abrasive paper and placed in an alcoholic solution, dust and oily stains on the surface are removed by an ultrasonic cleaner, and an essential crack detection process is accomplished;

step 2: the metal matrix sample is mounted on a loading platform of a combined process unit, the center of a laser beam spot is registered with the upper left corner of a surface to be shocked of the matrix at a point A to serve as a starting position of shock peening, and the X-axis and Y-axis directions of a region to be shocked arc coincident with the X-axis and Y-axis directions of the loading platform;

step 3: the chlorine-containing solution is sprayed onto the surface of the metal matrix by a spraying device so as to form a liquid constraining layer having a thickness of 1-2 mm;

step 4: an output power and spot parameters of a laser are set by means of a laser control device; the surface of a metal matrix sample is shocked with an intense pulsed laser, the metal matrix surface absorbs the laser energy and vaporizes and expands to form a high-temperature and high-pressure plasma, the chlorine-containing solution as constraining layer limits expansion of the plasma, generating a high-pressure shock wave having a strength of up to several to several tens GPa which far exceeds a yield strength of the metal component, so that the surface suffers from severe plastic deformation, the surface grains are refined and even nano-crystallized, a high value residual compressive stress is induced in the shock region, and chloride ions in the chlorine-containing solution and the surface metals are induced by the laser to form a passivation film;

step 5: the laser is opened, the sample loading platform is controlled to move by a robot control system using a progressive processing method, the surface to be processed of the metal matrix sample is subjected to large-area overlapping laser shock peening, and overlapping laser shock peening without an absorbing layer of the whole region to be shocked is finally accomplished; and step 6: the metal matrix sample in the chlorine-containing solution after the laser shock without an absorbing layer is subjected to ultrasonic alcohol cleaning, and after polishing, large-area overlapping laser shock peening at room temperature is conducted using aluminum foil as absorbing layer, thereby improving corrosion resistance of the metal component.

The laser used is a single-pulsed Nd:YAG laser with the operation parameters: wavelength 1064 nm, pulse width 5-10 ns, single pulse energy 1.5-10 J, and spot radius 1-3 mm.

The chlorine-containing solution is a 3.5% NaCl solution or a 42% $MgCl_2$ solution.

The polishing in step 6 is to ensure the surface flatness of the metal matrix sample, and to improve the efficiency of the last large-area overlapping laser shock peening with an absorbing layer under the premise of ensuring the layer integrity with the laser shock peening without an absorbing layer.

The absorbing layer of the laser shock peening is dedicated aluminum foil having a thickness of 0.10-0.12 mm.

The row and column overlapping rates in the large-area overlapping laser shock peening without an absorbing layer and the large-area overlapping laser shock peening with an absorbing layer are 50%. The present invention has following advantageous effects. In the present invention, using a chlorine-containing solution as constraining layer, large-area overlapping laser shock peening without an absorbing layer is performed, chloride ions in the chlorine-containing solution and the surface metals are induced by a laser to form a passivation film for improving corrosion resistance on the surface of the metal component, polishing is performed, and then large-area overlapping laser shock peening with an absorbing layer at room temperature is performed, thereby improving corrosion resistance of the metal component.

In the figures: 1. laser, 2. laser control device, 3. laser beam, 4. spraying device, 5. sample, 6. loading platform, 7. robot.

DETAILED DESCRIPTION OF THE EMBODIMENTS

The technical solution of the present invention is further described below in detail with reference to the accompanying drawings and specific embodiments.

Figure 1:
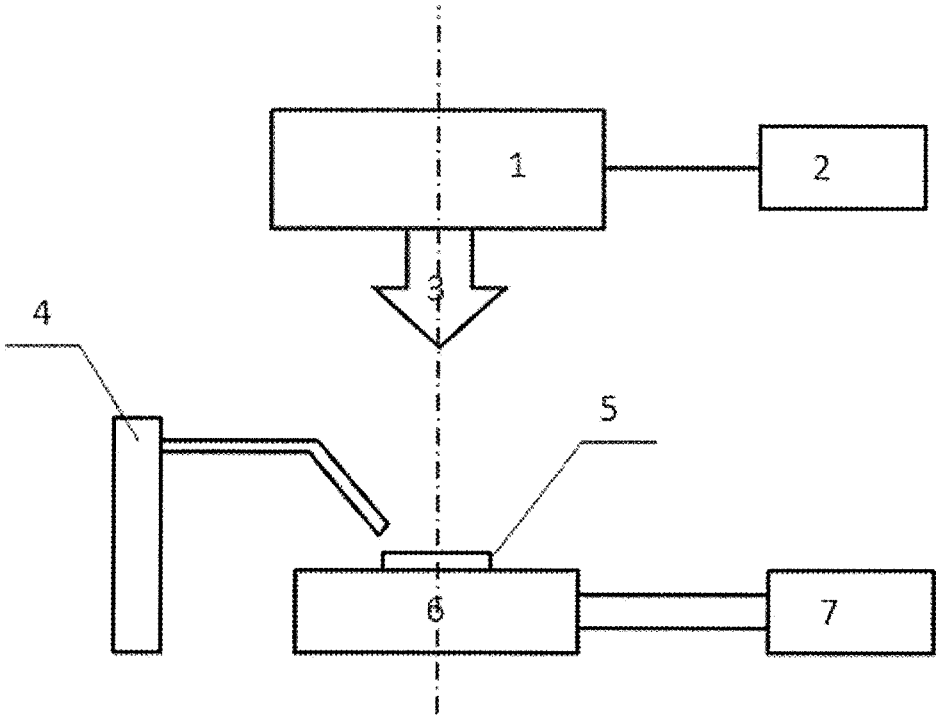
FIG. 1 is a schematic view of a combined process unit according to the present invention.

A combined process unit used in the present invention is shown in FIG. 1. In the present invention, using a chlorine-containing solution as constraining layer, overlapping laser shock peening without an absorbing layer is performed on the surface of a metal component, while residual compressive stress layer and grain refinement layer are induced on the surface, a chlorine-containing passivation film is formed so as to inhibit corrosion of ions, polishing is performed, and then overlapping laser shock peening with an absorbing layer at room temperature is performed, thereby improving corrosion resistance of the metal component.

Embodiment 1

316L stainless steel was selected as an object under investigation and was prepared into 40 mm×40 mm×5 mm blocky samples. The sample to be treated was placed in an alcoholic solution, dust and oily stains on the surface were removed by an ultrasonic cleaner, and an essential crack detection process was accomplished, ensuring that no significant cracks and defects were present on the surface.

The 316L stainless steel sample was mounted on a loading platform 6 of the combined process unit, the center of a laser beam spot was registered with the upper left corner of a surface to be shocked of the matrix at a point A to serve as a starting position of shock peening, and the X-axis and Y-axis directions of a region to be shocked were coincident with the X-axis and Y-axis directions of the loading platform.

A 3.5% NaCl solution was sprayed onto the matrix surface of the 316L stainless steel sample by a spraying device 4 so as to form a liquid constraining layer having a thickness of 1-2 mm.

An output power and spot parameters of a laser were set by means of a laser control device 2: wavelength 1064 nm, pulse width 5-10 ns, single pulse energy 1.5-10 J, and spot radius 1-3 mm. The surface of the 316L stainless steel matrix was shocked with an intense pulsed laser, the stainless steel surface absorbed the laser energy and vaporized and expanded to form a high-temperature and high-pressure plasma, a sodium chloride solution as constraining layer limited expansion of the plasma, generating a high-pressure shock wave having a strength of up to several to several tens GPa which far exceeded a yield strength of the stainless steel component, so that the surface suffered from severe plastic deformation, the surface grains were refined and even nano-crystallized, a high value residual compressive stress was induced in the shock region, and chloride ions in the sodium chloride solution and the surface metals were induced by the laser to form a passivation film, thereby improving corrosion resistance of the surface of the stainless steel metal component.

A laser 1 was opened, a sample loading platform 6 was controlled to move by a robot control system 7 using a progressive processing method, the surface to be processed of the sample was subjected to large-area overlapping laser shock peening at an overlapping rate of 50%, and overlapping laser shock peening without an absorbing layer of the whole region to be shocked was finally accomplished.

The metal sample in the sodium chloride solution after the laser shock without an absorbing layer was subjected to ultrasonic alcohol cleaning, and after polishing, large-area overlapping laser shock peening at room temperature at an overlapping rate of 50% was conducted using aluminum foil having a thickness of 0.10 mm as absorbing layer, thereby improving corrosion resistance of the metal component.

In the present embodiment, while a laser shock peening layer was induced on the surface of the 316L stainless steel sample, a chlorine-containing passivation film was formed so as to inhibit corrosion of ions, such that corrosion resistance was improved by 21%.

Embodiment 2

AISI 304 stainless steel was selected as an object under investigation and was prepared into 40 mm×40 mm×5 mm blocky samples. The sample to be treated was placed in an alcoholic solution, dust and oily stains on the surface were removed by an ultrasonic cleaner, and an essential crack detection process was accomplished, ensuring that no significant cracks and defects were present on the surface.

The AISI 304 stainless steel sample was mounted on a loading platform 6 of the combined process unit, the center of a laser beam spot was registered with the upper left corner of a surface to be shocked of the matrix at a point A to serve as a starting position of shock peening, and the X-axis and Y-axis directions of a region to be shocked were coincident with the X-axis and Y-axis directions of the loading platform.

A 3.5% NaCl solution was sprayed onto the matrix surface of the 316L stainless steel sample by a spraying device 4 so as to form a liquid constraining layer having a thickness of 1-2 mm.

An output power and spot parameters of a laser were set by means of a laser control device 2: wavelength 1064 nm, pulse width 8 ns, single pulse energy 6 J, and spot radius 2 mm. The surface of the AISI 304 stainless steel matrix was shocked with an intense pulsed laser, the stainless steel surface absorbed the laser energy and vaporized and expanded to form a high-temperature and high-pressure plasma, a sodium chloride solution as constraining layer limited expansion of the plasma, generating a high-pressure shock wave having a strength of up to several to several tens GPa which far exceeded a yield strength of the stainless steel component, so that the surface suffered from severe plastic deformation, the surface grains were refined and even nano-crystallized, a high value residual compressive stress was induced in the shock region, and chloride ions in the sodium chloride solution and the surface metals were induced by the laser to form a passivation film, thereby improving corrosion resistance of the surface of the stainless steel metal component.

A laser 1 was opened, a sample loading platform 6 was controlled to move by a robot control system 7 using a progressive processing method, the surface to be processed of the sample was subjected to large-area overlapping laser shock peening at an overlapping rate of 50%, and overlapping laser shock peening without an absorbing layer of the whole region to be shocked was finally accomplished.

The metal sample in the sodium chloride solution after the laser shock without an absorbing layer was subjected to ultrasonic alcohol cleaning, and after polishing, large-area overlapping laser shock peening at room temperature at an overlapping rate of 50% was conducted using aluminum foil having a thickness of 0.10 mm as absorbing layer, thereby improving corrosion resistance of the metal component.

In the present embodiment, while a laser shock peening layer was induced on the surface of the AISI 304 stainless steel sample, a chlorine-containing passivation film was formed so as to inhibit corrosion of ions, such that corrosion resistance was improved by 32%.

Embodiment 3

AM50 magnesium alloy was selected as an object under investigation and was prepared into 40 mm×40 mm×5 mm blocky samples. The sample to be treated was placed in an alcoholic solution, dust and oily stains on the surface were removed by an ultrasonic cleaner, and an essential crack detection process was accomplished, ensuring that no significant cracks and defects were present on the surface.

The AM50 magnesium alloy sample was mounted on a loading platform 6 of the combined process unit, the center of a laser beam spot was registered with the upper left corner of a surface to be shocked of the matrix at a point A to serve as a starting position of shock peening, and the X-axis and Y-axis directions of a region to be shocked were coincident with the X-axis and Y-axis directions of the loading platform.

A 3.5% NaCl solution was sprayed onto the matrix surface of the AM50 magnesium alloy sample by a spraying device 4 so as to form a liquid constraining layer having a thickness of 1-2 mm.

An output power and spot parameters of a laser were set by means of a laser control device 2: wavelength 1064 nm, pulse width 10 ns, single pulse energy 10 J, and spot radius 3 mm. The surface of the AM50 magnesium alloy matrix was shocked with an intense pulsed laser, the stainless steel surface absorbed the laser energy and vaporized and expanded to form a high-temperature and high-pressure plasma, a magnesium chloride solution as constraining layer limited expansion of the plasma, generating a high-pressure shock wave having a strength of up to several to several tens GPa which far exceeded a yield strength of the magnesium alloy component, so that the surface suffered from severe plastic deformation, the surface grains were refined and even nano-crystallized, a high value residual compressive stress was induced in the shock region, and chloride ions in the magnesium chloride solution and the surface metals were induced by the laser to form a passivation film, thereby improving corrosion resistance of the surface of the magnesium alloy metal component.

A laser 1 was opened, a sample loading platform 6 was controlled to move by a robot control system 7 using a progressive processing method, the surface to be processed of the sample was subjected to large-area overlapping laser shock peening at an overlapping rate of 50%, and overlapping laser shock peening without an absorbing layer of the whole region to be shocked was finally accomplished.

The magnesium alloy metal sample in the magnesium chloride solution after the laser shock without an absorbing layer was subjected to ultrasonic alcohol cleaning, and after polishing, large-area overlapping laser shock peening at room temperature at an overlapping rate of 50% was conducted using aluminum foil having a thickness of 0.10 mm as absorbing layer, thereby improving corrosion resistance of the magnesium alloy metal component.

Figure 2:
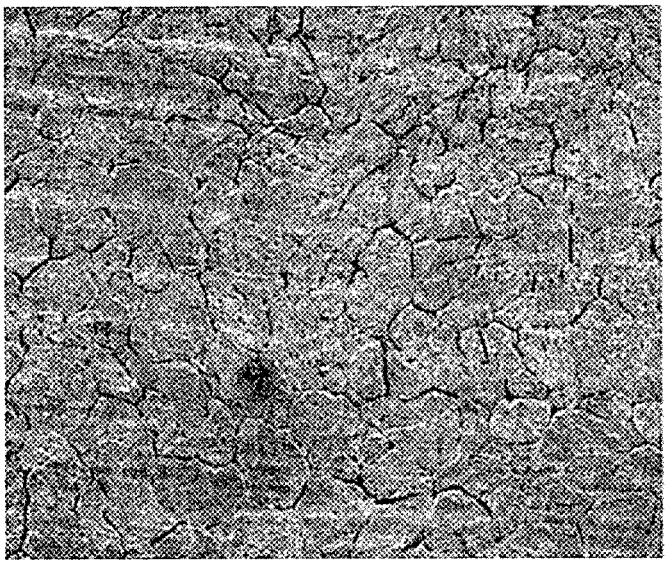
FIG. 2 is an image showing corrosion of microstructures on the surface of a metal component after treatment with conventional laser shock peening.
Figure 3:
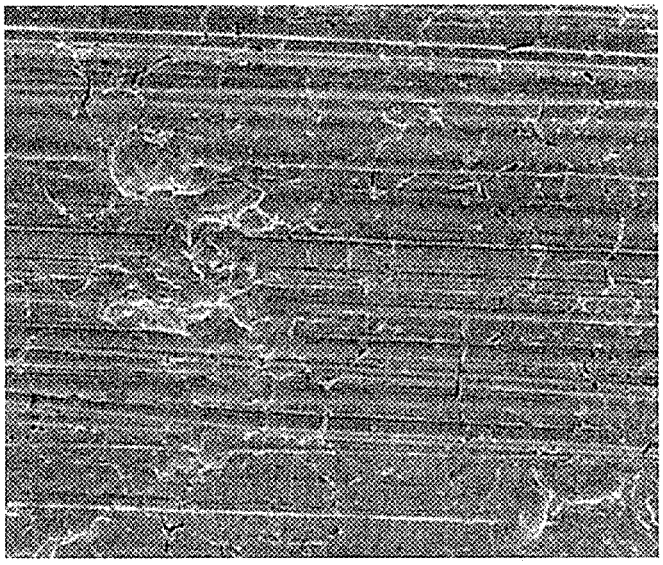
FIG. 3 is an image showing corrosion of microstructures on the surface of a metal component after treatment with a combined treatment method of the present invention.

In the present embodiment, while a laser shock peening layer was induced on the surface of the AM50 magnesium alloy sample, a chlorine-containing passivation film was formed so as to inhibit corrosion of ions, such that corrosion resistance was improved by 47%. An image showing corrosion of microstructures on the surface of a metal component after treatment with conventional laser shock peening is shown in FIG. 2. An image showing corrosion of microstructures on the surface of a metal component after treatment with the combined treatment method of the present invention with laser energy of 10 J is shown in FIG. 3. It can be seen that the combined treatment method of the present invention enables substantial improvement of corrosion resistance compared with the conventional laser shock peening.

What is claimed is:

1. A combined treatment method for improving corrosion resistance of a metal component in chlorine-containing solution, comprising, a metal component is placed in a chlorine-containing solution, wherein a liquid level of the chlorine-containing solution is higher than a surface of the metal component or a shock point by 1-2 mm, and the chlorine-containing solution is maintained in a state of circulation;

an area overlapping laser shock peening without an absorbing layer is used, when a pulsed laser is irradiated on a region to be shocked of the metal component, a surface of a metal matrix absorbs energy of the pulsed laser, vaporizes and expands to form plasma, the chlorine-containing solution as a constraining layer limits expansion of the plasma, generating a shock wave having an intensity exceeding a yield strength of the metal component, so that the surface of the metal matrix having plastic deformation is produced, a surface grain of the metal matrix is refined and even nano-crystallized, a residual compressive stress is induced in the region to be shocked of the metal component, and chloride ions in the chlorine-containing solution and the surface of the metal component are induced by the pulsed laser to form a chlorine-containing passivation film, such that a surface corrosion resistance of the metal component is improved;

after the area overlapping laser shock peening without the absorbing layer is conducted, a surface polishing is conducted on the surface of the metal component; and then, the surface of the metal component is subjected to an area overlapping laser shock peening with the absorbing layer at room temperature, such that the surface corrosion resistance of the metal component is further improved; the combined treatment method comprising the following steps:

step 1: the metal component to be treated is subjected to progressive grinding using a metallographic abrasive paper and placed in an alcoholic solution, dust and oily stains on the surface of the metal component are removed by an ultrasonic cleaner, and an essential crack detection process is accomplished;

step 2: a sample of the metal matrix is mounted on a loading platform of a combined process unit, a laser beam spot center is coincided with an upper left corner of the surface of the metal matrix with a region to be shocked at a point A to serve as a starting position for the area overlapping laser shock peening without the absorbing layer, and make X-axis and Y-axis directions of the region to be shocked to have same direction with X-axis and Y-axis directions of the loading platform;

step 3: the chlorine-containing solution is sprayed onto the surface of the metal matrix by a spraying device so as to form a liquid constraining layer having a thickness of 1-2 mm;

step 4: by setting an output power and spot parameters of the pulsed laser of a laser control device; a surface of the sample of the metal matrix is shocked with the pulsed laser, the surface of the metal matrix absorbs the energy of the pulsed laser, vaporizes and expands to form the plasma, the chlorine-containing solution as the constraining layer limits expansion of the plasma, generating the shock wave having the intensity exceeding the yield strength of the metal component, so that the surface of the metal matrix having plastic deformation is produced, the surface grain of the metal matrix is refined and even nano-crystallized, the residual compressive stress is induced in the region to be shocked, and chloride ions in the chlorine-containing solution and the surface of the metal matrix are induced by the pulsed laser to form a passivation film;

step 5: the pulsed laser of the laser control device is switched on, a sample movement of the loading platform is controlled by a robot control system using a progressive processing method, the surface of the sample of the metal matrix to be processed is subjected to the area overlapping laser shock peening without the absorbing layer, and the area overlapping laser shock peening without the absorbing layer for the whole region to be shocked is finally accomplished; and step 6: the sample of the metal matrix in the chlorine-containing solution after the area overlapping laser shock peening without the absorbing layer is subjected to ultrasonic alcohol cleaning, and after polishing, the area overlapping laser shock peening with the absorbing layer is conducted at room temperature using an aluminum foil as the absorbing layer, thereby improving the corrosion resistance of the metal component.

2. The combined treatment method for improving corrosion resistance of metal component in chlorine-containing solution according to claim 1, wherein the pulsed laser used is a single-pulsed Nd:YAG laser with operation parameters of: wavelength 1064 nm, pulse width 5-10 ns, single pulse energy 1.5-10 J, and spot radius 1-3 mm.

3. The combined treatment method for improving corrosion resistance of metal component in chlorine-containing solution according to claim 1, wherein the chlorine-containing solution is a 3.5 mass % NaCl solution or a 42 mass $MgCl_2$ solution.

4. The combined treatment method for improving corrosion resistance of metal component in chlorine-containing solution according to claim 1, wherein the polishing in step 6 is to ensure a surface flatness of the sample of the metal matrix, and to improve the efficiency of the last laser shock peening step of area overlapping laser shock peening with the absorbing layer, under the premise of ensuring the integrity of the metal component after the area overlapping laser shock peening without the absorbing layer.

5. The combined treatment method for improving corrosion resistance of metal component in chlorine-containing solution according to claim 1, wherein the absorbing layer of the area overlapping laser shock peening without the absorbing layer and the area overlapping laser shock peening with the absorbing area is an aluminum foil having a thickness of 0.10-0.12 mm.

6. The combined treatment method for improving corrosion resistance of metal component in chlorine-containing solution according to claim 1, wherein an overlapping rate of row and column in the area overlapping laser shock peening without the absorbing layer and the area overlapping laser shock peening with the absorbing layer is 50%.

* * * * *